United States Patent [19]

Uchida et al.

[11] Patent Number: 4,545,551

[45] Date of Patent: Oct. 8, 1985

[54] TRANSPORTING SYSTEM FOR VARIOUS KINDS OF COPS

[76] Inventors: Hiroshi Uchida, 141-31, Aza Shimoyakeya, Horigami-cho, Oumihachiman-shi, Shiga-ken; Kazuo Nakanishi, B-4 Sekisuihouse Wakabadai, 6-27, Sunada, Iseda-cho, Uji-shi, Kyoto-fu; Masaharu Kiriake, No. 208 Muratadanchi, 47, Funato-cho, Kisshoin Minami-ku, Kyoto-shi; Akira Shimano, 35, Mibukako-cho, Nakagyo-ku, Kyoto-shi, all of Japan

[21] Appl. No.: 514,102

[22] Filed: Jul. 15, 1983

[30] Foreign Application Priority Data

Jul. 19, 1982 [JP] Japan ..... 57-126542

[51] Int. Cl.[4] ..... B65H 54/20; B65H 67/06

[52] U.S. Cl. ..... 242/35.5 A; 28/297

[58] Field of Search ..... 242/35.5 A, 35.5 R, 242/35.6 R; 57/1, 281; 28/292, 297, 298

[56] References Cited

U.S. PATENT DOCUMENTS

| | | | |
|---|---|---|---|
| 1,115,115 | 10/1914 | Ryon | 28/298 |
| 1,144,006 | 6/1915 | Smart et al. | 28/298 |
| 3,195,298 | 7/1965 | Furst | 242/35.5 R X |
| 3,474,975 | 10/1969 | Brouwer et al. | 242/35.5 R |
| 3,480,128 | 11/1969 | Brouwer et al. | 242/35.5 R X |
| 3,774,859 | 11/1973 | Brouwer et al. | 242/35.5 A X |
| 4,010,907 | 3/1977 | Nishiyama et al. | 242/35.6 E X |
| 4,097,976 | 7/1978 | Ferguson et al. | 28/297 |
| 4,181,228 | 1/1980 | Hashimoto et al. | 242/35.5 R X |

FOREIGN PATENT DOCUMENTS

| | | | |
|---|---|---|---|
| 2061333 | 5/1981 | United Kingdom | 242/35.5 A |

*Primary Examiner*—Stanley N. Gilreath

*Attorney, Agent, or Firm*—Spensley, Horn, Jubas & Lubitz

[57] ABSTRACT

A system for transporting various kinds of cops to an automatic winder which includes a number of winding units. The winding units are divided into a plurality of winding sections, whereby a kind of cops from a spinning frame are supplied to and unwound on one of the sections. A cop supplying passage and an empty bobbin returning passage are provided between the sections and the spinning frame so as to form a closed loop.

12 Claims, 6 Drawing Figures

TRANSPORTING SYSTEM FOR VARIOUS KINDS OF COPS

BACKGROUND OF THE INVENTION

This invention relates to a system for transporting various kinds of cops to an automatic winder.

Cops on which yarns that have been spun on a fine spinning frame are wound are normally rewound in order to remove defects of yarns or to obtain packages of a size and a configuration adapted for a succeeding next process. An automatic winder used for this rewinding process includes a number of winding units. In each winding unit, a yarn is drawn out at a high speed from a cop supplied thereto and is taken up by or wound on a package which is rotated by a driving drum. If the yarn on the cop has been completely removed therefrom, then a next new cop is supplied and a yarn thereon is knotted or spliced with the yarn on the package so as to effect another winding operation onto the package. In this way, a plurality of cops are supplied in order to obtain a fully wound package. Especially in ring spinning frames which prevail over other fine spinning frames, the quantity of a yarn wound on a cop is small and is limited to some hundreds grammes due to their structural restrictions. Thus, assuming that the quantity of yarn on a cop is 200 grams and the quantity of yarn on a fully wound package is 3 kgs., a quantity of yarns corresponding to at least 15 cops must be supplied in order to obtain a package.

Further, the spinning speed of a fine spinning frame is commonly 15 to 20 m/min, while the winding speed of an automatic winder is as high as 1000 m/min. Accordingly, if 50 to 60 fine spinning units of a fine spinning frame are provided for a single winding unit of a winder, the fine spinning process and the rewinding process are balanced well so that they can be accomplished efficiently as a whole.

Thus, when production of different kinds of products in a small quantity is to be effected under the conditions as described above, in a conventional system, different kinds of yarns are produced on each fine spinning frame and are rewound with a single winder. Accordingly, if five different kinds of yarns are produced on five fine spinning frames each having 400 spindles thereon and are rewound with five winders, then each winder will include 12 winding units and it will be necessary to provide each winder with a driving source, a blower, and so on. The conventional systems are thus extremely uneconomical and are disadvantageous in spacing if winders are not arranged appropriately.

SUMMARY OF THE INVENTION

The present invention relates to a system for transporting various kinds of cops to an automatic winder.

An object of the present invention is to provide an efficient automatic cop transporting system which prevents different kinds of cops from being supplied to a winding unit.

According to the present invention, a winder which includes a number of winding units therein is substantially divided into a plurality of winding sections, whereby a kind of cops produced on a fine spinning frame are supplied to and unwound on one of the sections while a different kind of cops produced on another fine spinning frame are supplied to another one of the sections, and a cop supplying pasage and an empty bobbin returning passage are provided between the sections and the spinning frame so as to form a closed loop.

DETAILED DESCRIPTION OF THE INVENTION

In the following, an embodiment of the present invention will be described with reference to the accompanying drawings.

Figure 1:
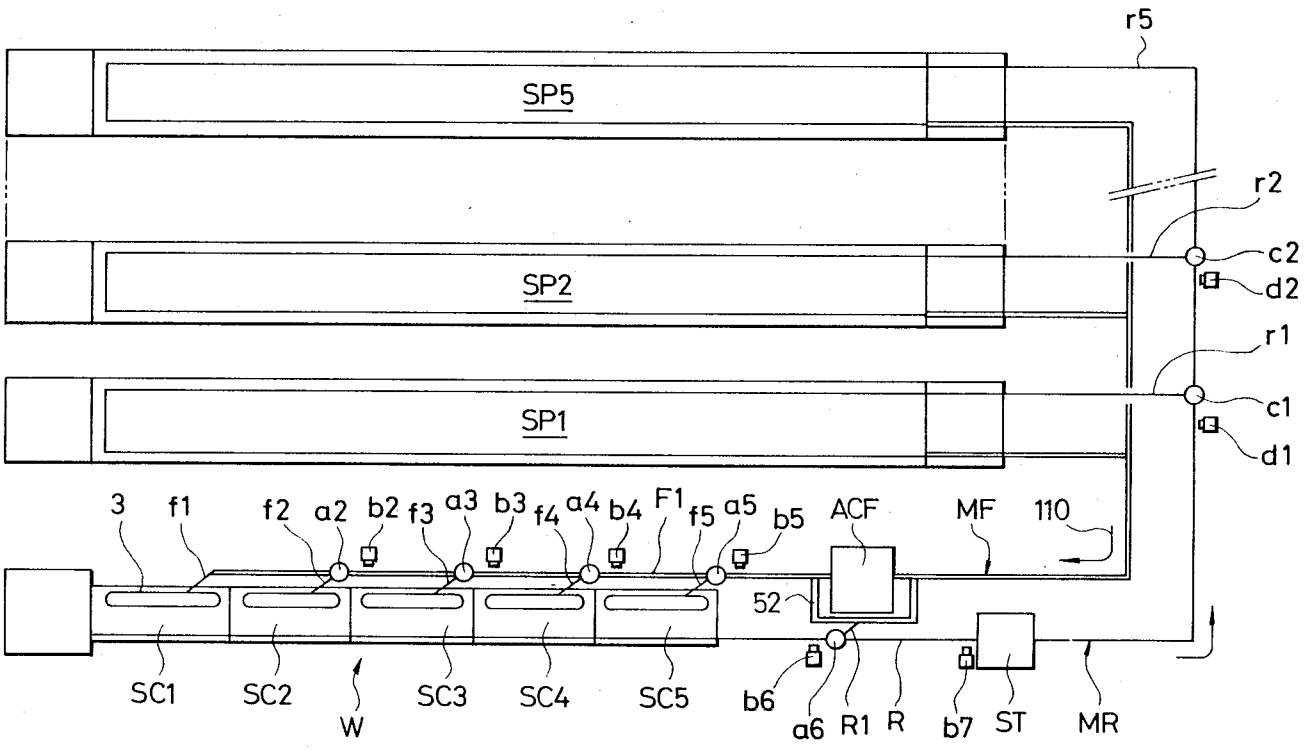
FIG. 1 is a diagrammatic representation showing an embodiment of a system according to the present invention.

FIG. 1 illustrates the layout of a system of the invention. A plurality of fine spinning frames SP1 to SP5 are provided in parallel relationship for an automatic winder W. The winder W is substantially divided into a plurality of sections SC1 to SC5 in which different kinds of cops are rewound. Between the fine spinning frames SP1 to SP5 and the winder W are provided a cop supplying passage MF as shown by a dual line for transporting cops and a returning passage MR for transporting empty bobbins or bobbins with remaining yarns discharged from the winder. The cop supplying passage MF includes a main supplying passage F1 for transporting different kinds of cops supplied from the fine spinning frames, and branch supplying passage f1 to f5 which branch from the main supplying passage F1 and connect to the winding sections SC1 to SC5 of the winder. Meanwhile, the returning path MR includes a common returning passage R which extend through the sections SC1 to SC5 and connect to the fine spinning frames, and branch returning paths r1 to r5 which branch to the respective fine spinning frames.

A reading device ACF for seeking and removing a starting end of a yarn from a spinning cop is disposed at a portion of the main supplying path F1, and cop selectors a2 to a5 and cop discriminating sensors b2 to b5 are disposed at positions of the main supplying passage F1 adjacent the winding sections. On the other hand, a passage R1 for feeding a bobbin with a yarn to the readuing device ACF is connected to an intermediate portion of the returning passage R by way of a selector a6, and a minimum remaining yarn removing device ST for removing a remaining yarn from a bobbin with a minimum remaining yarn is additionally disposed intermediate the returning passage R. The system also includes a sensor b6 for detecting a bobbin with a remaining yarn, and another sensor b7 for detecting a bobbin with a minimum remaining yarn. Further, bobbin selectors c1, c2, . . . and bobbin discriminating sensors d1, d2, . . . are disposed at positions of the returning path R adjacent the fine spinning frames.

Figure 3:
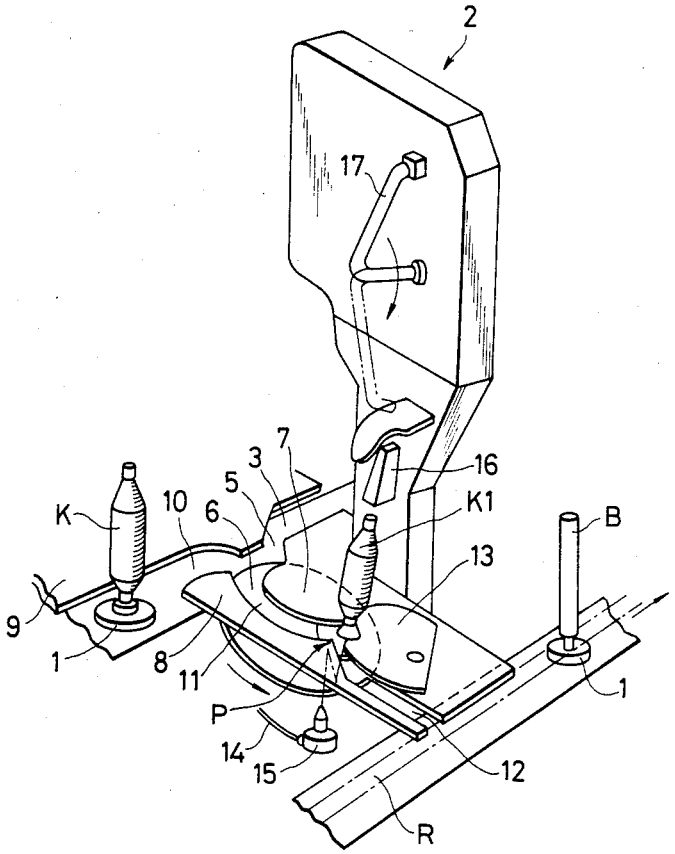
FIG. 3 is a perspective view, in diagrammatic representation, showing an example of a winding unit employed in a system of the present invention.

In this system, a cop K is transported under the condition held uprightly erected on an independent transporting medium (hereinafter referred to as a "tray" 1) as shown in FIG. 3. A cop is supplied to and discharged from a winding unit while being held in the condition uprightly fitted on a tray, and an empty bobbin fitted on a tray is returned to a fine spinning frame by way of the returning passage. As for discrimination of kinds of cops, various discriminating means can be applied: for example, colors of trays may be differentiated for individual kinds of yarns and thus discriminated by means of photosensors; or a number of recesses differentiated for individual kinds of yarns may be formed at a portion of each tray and thus the kind of a yarn may be discriminated by means of a touch sensor; and so on. The present system illustrates an example in which a photoelectric mark sensor is employed.

Figure 2:
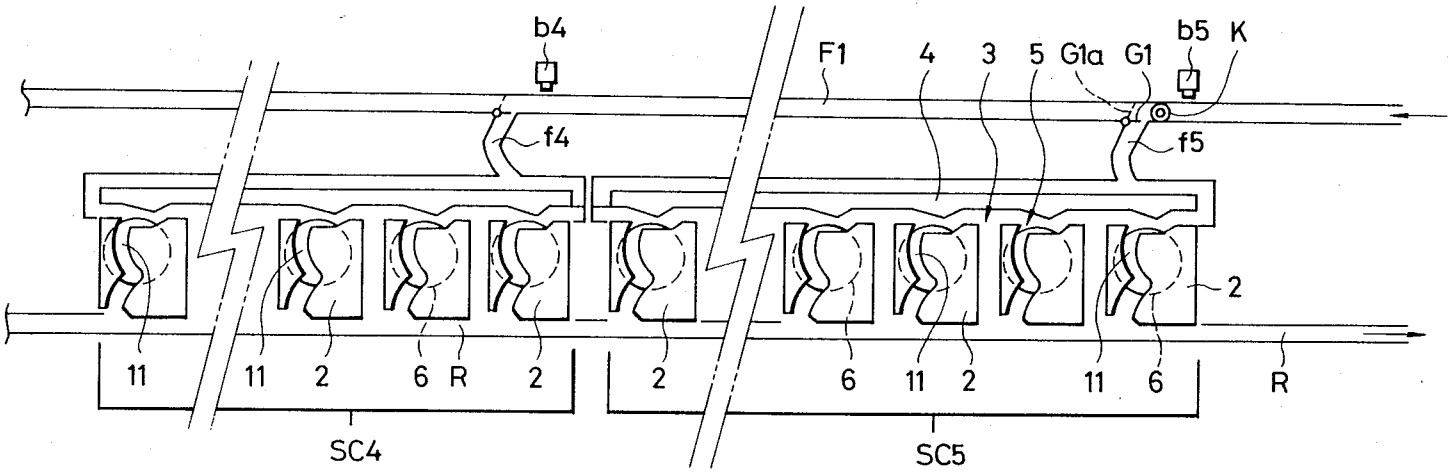
FIG. 2 is a plan view showing cop transporting passages in winding sections.

FIG. 2 is a plan view showing cop transporting passages in the winder. While only two section SC5 and SC4 are shown in this figure, it must be mentioned that the remaining sections are constructed similarly. A cop delivering path 3 extends along the winding units 2 on one side thereof and connects to the branch supplying passage f5. The cop delivering path 3 is constructed, for example, from a belt conveyor and guide plates 4, and has a cop inlet port 5 into each winding unit. The returning passage R for transporting empty bobbins after unwinding of yarns therefrom and bobbins with remaining yarns and bobbins with minimum remaining yarns discharged from the winding units because they are not prepared for connection of yarns extends along the winding units on the other side thereof and commonly through the sections. The returning passage is constructed, for example, from a belt conveyor and guide plate.

FIG. 3 illustrates an example of a winding unit 2 which is applied to the system as described above and an example of a tray 1 serving as a transporting medium for a cop. The winding unit 2 is disposed between the cop delivering passage 3 and the returning passage R, and a cop is taken in from the delivering passage 3 by means of a rotary disk 6 and guide plates 7, 8 and 9. The guide plates 7, 8 are secured in a fixed spaced relationship from an upper face of the rotary disk 6 above the rotary disk 6. The cop inlet port 5 and a surplus cop outlet port 10 are defined by and between the guide plates 7, 8 and the guide plate 9, respectively, and a cop stand-by guideway 11 and a bobbin discharging guideway 12 are defined by and between the guide plates 7 and 8. A whirling lever 13 is provided for discharging an empty bobbin and a bobbin with a remaining yarn from an unwinding position. An air injection nozzle 15 is disposed below a tray 1 at the unwinding position P and connects to a conduit 14 which communicates with a compressed air supply source not shown. Air injected from the nozzle 15 passes through a spacing within a peg of the tray 1 and is injected into a wood pipe of the bobbin through a hole perforated at an upper end portion of the peg to blow up an end of a yarn which has been suspended within the wood pipe. Additionally provided above the cop K1 at the unwinding position are a balloon breaker 16, a relay pipe 17 for introducing an end of a yarn of a cop to a yarn knotting or splicing device not shown, a package on which a yarn drawn from a cop is to be taken up, a suction mouth for introducing an end of a yarn of the package to the yarn joining device, a slub catcher for detecting defects of yarns, and so on.

Figure 5:
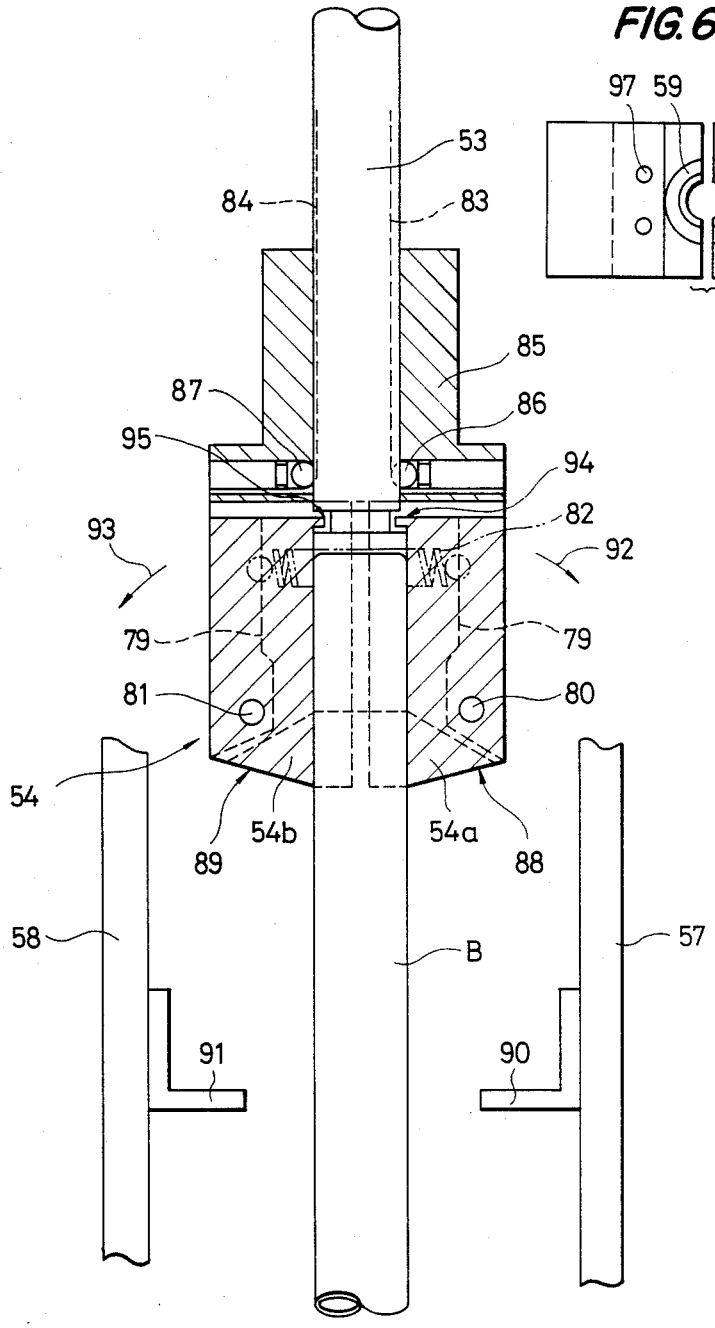
FIG. 5 is a sectional view showing a chuck of the minimum remaining yarn removing device.
Figure 6:
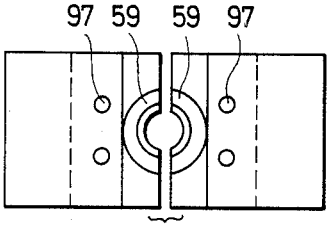
FIG. 6 is a plan view of a remaining yarn removing member.

Next, an example of a minimum remaining yarn removing device ST is illustrated in FIGS. 5 to 7. Referring to FIG. 5, the device includes a bobbin chuck 54 depending from a lower end of a lifting rod 53 and mounted for sliding movement along the rod 53, remaining yarn removing members 59, 60 and 61 secured to a lower end of each of rocking members 57, 58 which are mounted for rocking motion around shafts 55 and 56, respectively, and so on.

The rocking members 57, 58 are each formed as an obtuse angle member and mounted for rocking motion on the shafts 55, 56, respectively, which are secured to a machine frame not shown. Levers 62 and 63 for controlling open and closed positions of the rocking members 57 and 58 are supported for pivotal motion as at 64 and 65 at upper ends of the rocking members 57 and 58, respectively. The levers 62 and 63 are connected, by way of rods 68 and 69, to further levers 66 and 67 mounted for pivotal motion around the shafts 55 and 56, respectively. The levers 66, 67 are connected to each other at adjacent ends thereof by means of a connecting rod 70 for integral motion therebetween. In addition, another rod 71 is connected to one 66 of the levers 66, 67 and disposed to be moved up and down by means of a cam of a driving source. Further, guide rails 74 and 75 are mounted for pivotal motion on the shafts 55 and 56, respectively, and disposed to guide rollers 72 and 73, respectively, when the chuck 54 moves up and down. The guide rails 74 and 75 have guide grooves 76 and 77 formed on inside faces thereof, respectively.

Meanwhile, the vertical rod 53 is secured to a lifting member 78 which is mounted for up and down movement along the guide rails 74, 75. The rod 53 is moved up and down by a cylinder or any other suitable mechanism. The rod 53 has the bobbin chuck 54 supported at the bottom end thereof, as shown in FIG. 6. The chuck 54 includes a pair of chucking members **54*a* and 54*b* which are supported for pivotal motion as at 80 and 81, respectively, on a bracket 79 and are urged in a direction to clamp a bobbin therebetween by means of a spring 82 extending between the chucking members 54*a*, 54*b*. Further, the lifting rod 53 can extend downwardly through the chuck when the chucking members 54*a*, 54*b* are in their open position. Only the rod 53 is enabled to slide downwardly by cooperation of guide grooves 83 and 84 formed in the rod 53 with spring urged balls 86 and 87 within the bracket 85. In particular, in FIG. 6, if the chuck 54 having a bobbin B clamped thereon is moved down together with the rod 53, at first inclined faces 88 and 89 at lower ends of the chucking members 54*a* and 54*b* are abutted against stopper members 90 and 91 of the rocking members 57 and 58, respectively. Then, if the chuck 54 is further moved down, the chucking members 54*a*, 54*b* are acted upon by moments in the directions of arrow marks 92, 93 about the shafts 90, 91, respectively, so that the chucking members 54*a*, 54*b* are opened thereby, and as a result, the rod 53 is allowed to move down without being arrested by upper end faces 94, 95** of the chucking members.

Further, a pair of remaining yarn removing means 96 are provided which each include a first removing member 59, and second removing member 60 and a third removing member 61 which are all secured to a lower portion of each of the rocking members 57, 58 by means of a pin 97 such that they may engage with a circumferential face of a bobbin B, as shown in FIGS. 5 and 7. The first and second removing members 59, 60 are made of a metal while the third removing member 61 is a block of alternate rubber and metal layers.

In addition, the rocking members 57, 58 have bobbin guides 98, 99 fixedly mounted thereon by means of brackets 100, 101, respectively, and serving as guiding means for fitting of an emtpy bobbin after removal of a remaining yarn onto a peg of a tray as described above. The bobbin guides 98, 99 are thus opened and closed by opening and closing operations of the rocking members 57, 58, and when a bobbin is stopped at a position just below the bobbin chuck 54 or when feeding of a bobbin is resumed, the bobbin guides 98 and 99 are open whereas they are closed during a remaining yarn removing operation.

Accordingly, when a bobbin with a minimum remaining yarn comes to a position adjacent the removing device, the rod 53 is moved down so that the top end of the bobbin is pressed between and grasped by the chucking members 54*a* and 54*b*. As a result, when the rod 53 is subsequently moved up, the bobbin is raised to an uppermost raised position (a full line position in FIG. 5). It is to be mentioned that, while a bobbin in its grasped position is being raised, the rocking members 57, 58 are in respective phantom positions 57*a*, 58*a* and the removing members 59, 60 and 61 are also in their leftwardly or rightwardly retracted position. In particular, as the rod 53 is moved down by the cam not shown, the lever 66 is held positioned to its phantom position 66*a*. Accordingly, the lever 62 connected to the lever 66 by the rod 68 is pivoted in a clockwise direction about the shaft 64 so that the end 62*a* thereof which has been pressed against the guide rail 74 is removed therefrom to allow the spring 102 to pivot the rocking members 57, 58 in the directions of arrow marks 103, 104 about the shafts 55, 56, respectively. As a result, the rocking members 57, 58 are brought to their respective phantom positions.

Subsequently, the rod 71 is reversely pulled up while the bobbin B with a remaining yarn is in its raised position. As a result, the rocking members 57 and 58 are brought to their respective full line positions through a reverse sequence of operations and thus the removing members 59 are engaged with an outer circumferential face of a lower end portion of the bobbin. Then, as the rod 53 is moved down again, the chuck 54 having the bobbin B grasped thereon is also lowered whereupon a remaining yarn 105 on the bobbin B will be raked up with the removing members 59, 60, 61 and so on. It is to be noted that a bobbin normally has a slightly tapered face thereon so that, when the remaining yarn 105 is raked up with the removing members 59, 60 and 61 and only the bobbin B is lowered, there will appear a gap between the reamining yarn 105 and the bobbin B and hence clamping of the yarn upon the bobbin will be loosed sufficiently to allow the bobbin to be manually drawn out from the yarn.

Then, the chucking members 54*a*, 54*b* are further moved down, and as the lower end faces thereof are abutted against the stoppers 90, 91 of the rocking members 57, 58, respectively, the chucking members 54*a*, 54*b* are opened in a manner as described in detail hereinabove with reference to FIG. 6 so that only the empty bobbin is pushed to be moved down by the bobbin end of the lifting rod and separated from the chucking members. And then, when the empty bobbin has passed by and released from the removing members 59, 60 and 61, it will drop between the guide members 98, 99 and be fitted onto an empty tray which is in its stand-by position below. It is to be mentioned that the remaining yarn which is left on the removing members 59 is conveniently sucked and removed therefrom by a suction means such as a suction pipe.

It is to be noted that the guide rails 74, 75 have, adjacent the top ends thereof, tapered faces 106, 107, respectively, having the same slope with the aforementioned tapared face of a bobbin in order that, as a bobbin is lowered, the guide rails 74, 75 may be slightly pivoted in the directions of arrow marks 108, 109 by the rollers 72, 73, respectively, whereby the removing members 59, 60, 61 are pivoted by way of the levers 62, 63 and the rocking members 57, 58 and are thus assuredly pressed against the bobbin.

Now, in the system having a construction as described hereinabove, or for example, in FIG. 1, it is assumed that different yarns are produced on the fine spinning frames SP1 to SP5 and the fine spinning frames each correspond to one winding section such that yarns produced on the fine spinning frame SP1 are rewound at the winding section SC1, yarns produced on the frame SP2 are rewound at the section SC2, and so on.

Figure 4:
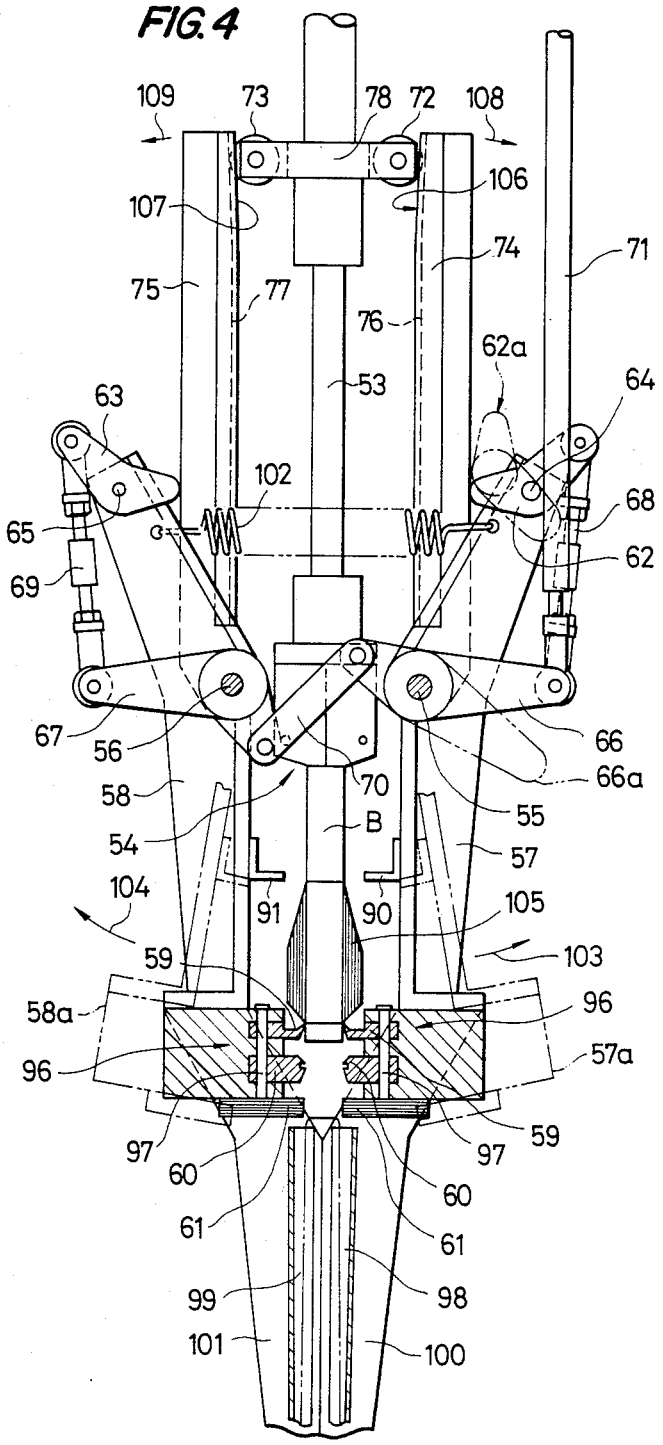
FIG. 4 is a partially broken front elevational view showing an example of a minimum remaining yarn removing device.

Cops obtained in the fine spinning frames are fitted on trays which are differentiated in color for individual kinds of yarns, and are fed in groups by individual kinds of yarns or fed individually irrespective of kinds of yarns. Yarns of cops fed in the direction of an arrow mark 110 are sequentially picked up by the readying device ACF as shown in FIG. 4 so that the cops will be thereafter fed on the main supplying passage F1 with ends of yarns thereof being suspended in center bores of the bobbins thereof. Cops which have failed in seeking yarns are supplied again to the readying device via the feedback passage 52.

Cops thus picked up are then fed on the main supplying passage F1 toward the winder W and comes to a position adjacent the cop discriminating sensor b5 on the way. If the sensor b5 discriminates a cop from the fine spinning frame SP5 depending upon the color of the tray, it will provide an operating instruction to the selector a5 so that the gate G1 as shown in FIG. 2 will be pivoted to its broken line position G1*a* to allow the cop K to be introduced into the branch supplying passage f5 and thus supplied onto the cop delivering passage 3 of the section SC5.

Accordingly, it is apparent that cops from the fine spinning frame SP1 will pass in order by the sensors b5, b4, b3 and b2 and hence be supplied to the cop delivering path 3 of the section SC1 by way of the branch supplying passage f1.

In this way, cops from the individual fine spinning frames are supplied to the respective winding sections corresponding to the frames. In each section, cops are taken into the stand-by guideway 11 above the disk 6 through the cop inlet port of each winding unit 2 and are successively brought to the unwinding position while they are held fitted on trays 1 in order to effect rewinding there.

Empty bobbins after completion of rewinding on the units and bobbins with remaining yarns thereon discharged due to impossible yarn connection thereof are then fed on the common returning passage R. It is to be noted that kinds (colors) of trays are random here. Empty bobbins having no remaining yarns thereon are fed on the returning passage R, passing by the remaining yarn removing device ST, toward the fine spinning frames. Thus, the empty bobbins are classified by cooperation of the discriminating sensors d1, d2, . . . with the selectors C1, C2, . . . which operate in response to the sensors, and are thus fed back to the individual particular fine spinning frames SP1 to SP5.

As apparent from the foregoing description, the present invention provides a transporting system for transporting different kinds of cops after fine spinning to a winder which includes a number of winding units therein and is divided into a plurality of winding sections in which different kinds of yarns are rewound, wherein the winder and a plurality of fine spinning frames for producing various kinds of yarns thereon are interconnected by a main supplying passage and a returning passage which are both common to the various kinds of yarns, thereby forming a closed loop, and the main supplying passage and the individual section of the winder are interconnected by branch supplying passages. Thus, according to the present invention, a plurality of kinds of yarns can be rewound on a single winder without the necessity of provision of each fine spinning frame with an individual winder and without the necessity of provision, for each of a plurality of kinds of yarns, a cop transporting passage directly interconnecting fine spinning frames and a winder to each other, thereby enabling efficient utilization of a space of a factory. Further, if the number of winding units of each section is adjusted appropriately, it may be possible to attain balancing between the productivity of a fine spinning frame and the processing facility of winding sections, and thus the difference of productivity caused by differences of kinds of yarns can be adjusted on the side of winding units. In this way, the fine spinning and rewinding processes can be rendered efficient and wasteful time can be eliminated.

What is claimed is:

1. A system for transporting different kinds of cops after fine spinning to a winder which includes a number of winding units therein and is divided into a plurality of winding sections in which different kinds of yarns are rewound, characterized in that said winder and a plurality of fine spinning frames for producing various kinds of yarns thereon are interconnected by supply means for supporting and transporting cops in an upright position along a main supplying passage and return means for supporting and transporting bobbins in an upright position along a returning passage, the supply means and the return means being common to the various kinds of yarns, said supply means and the individual sections of said winder are interconnected by branch supply means for supporting and transporting cops in an upright position along branch supplying passages, the branch supply means and the return means being interconnected by cop delivery means for supporting and transporting cops from the branch supply means to a winding unit where an unwinding operation occurs thereby forming bobbins and for supporting and transporting said bobbins to the return means, wherein cop discriminating sensors are disposed along the main supply passage adjacent to the branch supply passage and wherein cop selectors which are actuated by the cop discriminating sensors and which control whether a cop travels along the main supply passage or along a particular branch supply passage are disposed along the main supply passage adjacent the particular branch supply passage.

2. A system as claimed in claim 1, wherein the cop selectors and the cop discriminating sensors are disposed at positions of said main supplying passage adjacent each winding sections.

3. A system as claimed in claim 1, wherein bobbin selectors and bobbin discriminating sensors are disposed at positions of said returning passage adjacent each fine spinning frame.

4. A system as claimed in any of claims 1 to 3, wherein a minimum remaining yarn removing device for removing a remaining yarn from a bobbin with a minimum remaining yarn is further disposed intermediate said returning passage.

5. A system as claimed in any of claims 1–3, further including a transporting medium for transporting a cop in an upright erected condition and wherein the cop is supplied to a winding unit while being held in the condition uprightly fitted on the medium, and an empty bobbin fitted on the medium is returned to a fine spinning frame by way of the returning passage after the completion of the unwinding operation.

6. A system as claimed in claim 5, wherein the transporting medium is colored in order to discriminate the kinds of cops and individual kinds of yarn, and wherein the colored transporting medium is discriminated by means of photosensors.

7. A system as claimed in claim 5, wherein in order to discriminate the kinds of cops, a number of recesses differentiated for individual kinds of yarns are formed at a portion of each transporting medium and the kind of yarn is discriminated by means of a touch sensor.

8. A system for transporting different kinds of cops as claimed in claim 4, wherein the minimum remaining yarn removing device comprises a lifting rod, a bobbin chuck depending from a lower end of the lifting rod and mounted for sliding movement along the lift rod, rocking members which are mounted for rocking motion around shafts, respectively, being arranged to put the lifting rod and the bobbin chuck therebetween and provide stopper members at lower portion thereof for being able to abut against the bobbin chuck and a pair of remaining yarn removing means secured to a lower end of each of the rocking members, said bobbin chuck including a bracket, a pair of chucking members which are supported for pivotal motion on the bracket, respectively, and a spring extending between the chucking members and urging the chucking members in a direction to clamp a bobbin therebetween and said lifting rod being able to extend downwardly through the chuck when the chucking members are in their open position so that an empty bobbin having no yarn thereon is released and discharged from the minimum remaining yarn removing device.

9. A system for transporting various kinds of cops to a winder having a series of winding units corresponding to the various kinds of cops and for transporting the bobbins resulting from operation of the winder to a series of spinning frames having particular spinning frames corresponding to the various kinds of cops, the system comprising:

main cop supply means for conveying all of the various kinds of cops from the series of spinning frames to the winder;

main bobbin supply means for conveying all of the bobbins resulting from operation of the winder to the series of spinning frames, the main cop supply means and the main bobbin supply means forming a closed loop between the winder and the series of spinning frames;

particular cop supply means for conveying a particular kind of cop from the main cop supply means to a winding unit corresponding to the kind of cop conveyed;

winder supply and discharge means for conveying a cop to a winding unit and a bobbin resulting from operation of said winding unit to the main bobbin supply means;

cop discriminating sensor means for discriminating between the various kinds of cops traveling on the main cop supply means; and cop selector means actuated by a cop discriminating sensor means for guiding a particular kind of cop from the main cop supply means to the particular cop supply means corresponding to said particular kind of cop.

10. A system according to claim 9 wherein the main cop supply means and the main bobbin supply means and the particular cop supply means comprises conveyor belts and guide plates and wherein the winder supply and discharge means comprises guide plates for guiding the cop through the winding unit and a rotary disc disposed under the guide plates for supporting and transporting the cop as the cop is guided through the winding unit.

11. A system according to claim 10 further comprising independent trays for supporting the cops and bobbins in an upright position spaced apart from each other.

12. A system according to claim 11 further including bobbin discriminating sensor means for discriminating between the various kinds of bobbins traveling on the main bobbin supply means; and bobbin selector means actuated by a bobbin discriminating sensor means for directing a particular kind of bobbin from the main bobbin supply means to the corresponding particular spinning frame.

* * * * *